US011295615B2

(12) United States Patent
Xu et al.

(10) Patent No.: US 11,295,615 B2
(45) Date of Patent: Apr. 5, 2022

(54) SLOWDOWN EVENTS

(71) Applicant: HERE Global B.V., Eindhoven (NL)

(72) Inventors: Jingwei Xu, Buffalo Grove, IL (US); Pradeep Maddineni, Lombard, IL (US); Bruce Bernhardt, Wauconda, IL (US); Yuxin Guan, Chicago, IL (US); Zongyi Xuan, Eindhoven (NL); Weimin Huang, Chicago, IL (US); Jennifer Carter, Arlington, VA (US); Casey Bennett, Chicago, IL (US); Yingzhou Yu, Northbrook, IL (US); Mark Timms, Frome (GB)

(73) Assignee: HERE Global B.V., Eindhoven (NL)

( * ) Notice: Subject to any disclaimer, the term of this patent is extended or adjusted under 35 U.S.C. 154(b) by 132 days.

(21) Appl. No.: 16/662,468

(22) Filed: Oct. 24, 2019

(65) Prior Publication Data

US 2020/0135022 A1 Apr. 30, 2020

Related U.S. Application Data

(60) Provisional application No. 62/751,747, filed on Oct. 29, 2018.

(51) Int. Cl.

| | |
|---|---|
| ***G08B 21/00*** | (2006.01) |
| ***G08G 1/0967*** | (2006.01) |
| ***G08G 1/01*** | (2006.01) |

(52) U.S. Cl.

CPC ..... *G08G 1/096716* (2013.01); *G08G 1/0112* (2013.01); *G08G 1/0133* (2013.01); (Continued)

(58) Field of Classification Search

CPC ..... G08G 1/096716; G08G 1/0112; G08G 1/0133; G08G 1/0141; G08G 1/096741; G08G 1/096775; G08G 1/096791

(Continued)

(56) References Cited

U.S. PATENT DOCUMENTS

| | | | |
|---|---|---|---|
| 9,576,481 | B2 | 2/2017 | Xu |
| 9,865,019 | B2 | 1/2018 | Bogovich et al. |

(Continued)

FOREIGN PATENT DOCUMENTS

| | | | |
|---|---|---|---|
| EP | 3222973 | A2 | 9/2017 |
| WO | WO9930303 | A1 | 6/1999 |

(Continued)

OTHER PUBLICATIONS

European Search Report for European Patent Application No. 19205956.6-1203 dated Mar. 26, 2020.

(Continued)

*Primary Examiner* — Mark S Rushing

(74) *Attorney, Agent, or Firm* — Lempia Summerfield Katz LLC

(57) ABSTRACT

A method for providing alerts for a traffic slowdown includes receiving location data for at least a first vehicle of a plurality of vehicles, map matching the location data for at least the first vehicle to a road network, calculating an approaching speed for at least the first vehicle at a first time, calculating a final speed for at least the first vehicle at a second time, and generating a traffic slowdown message in response to the approaching speed and the final speed. The traffic slowdown message includes at least one characteristic of the traffic slowdown.

15 Claims, 9 Drawing Sheets

(52) U.S. Cl.
CPC ..... *G08G 1/0141* (2013.01); *G08G 1/096741* (2013.01); *G08G 1/096775* (2013.01); *G08G 1/096791* (2013.01)

(58) Field of Classification Search
USPC ..... 340/463; 701/117, 119
See application file for complete search history.

(56) References Cited

U.S. PATENT DOCUMENTS

| | | | | |
|---|---|---|---|---|
| 9,953,524 | B2 | 4/2018 | Xu | |
| 9,983,013 | B1 | 5/2018 | Krunic et al. | |
| 10,395,526 | B1 | 8/2019 | Slusar | |
| 10,540,892 | B1 | 1/2020 | Fields et al. | |
| 2002/0036584 | A1* | 3/2002 | Jocoy | G01S 13/931 342/70 |
| 2007/0213922 | A1* | 9/2007 | Van Buer | H04W 4/44 701/117 |
| 2007/0259634 | A1 | 11/2007 | Macleod | |
| 2008/0167955 | A1 | 7/2008 | Zerod | |
| 2010/0286899 | A1* | 11/2010 | Jain | G08G 1/127 701/119 |
| 2012/0086583 | A1 | 4/2012 | Morrison | |
| 2016/0071411 | A1* | 3/2016 | Stenneth | G08G 1/0112 701/118 |
| 2016/0078757 | A1 | 3/2016 | Inaba | |
| 2017/0116852 | A1 | 4/2017 | Xu | |
| 2017/0241791 | A1 | 8/2017 | Madigan et al. | |
| 2018/0059669 | A1 | 3/2018 | Madigan et al. | |
| 2018/0107216 | A1 | 4/2018 | Beaurepaire et al. | |
| 2018/0127001 | A1 | 5/2018 | Ricci | |
| 2019/0051153 | A1 | 2/2019 | Giurgiu et al. | |
| 2019/0051172 | A1 | 2/2019 | Stenneth et al. | |
| 2019/0080266 | A1 | 3/2019 | Zhu et al. | |
| 2019/0101924 | A1 | 4/2019 | Styler et al. | |
| 2019/0102840 | A1 | 4/2019 | Perl et al. | |
| 2019/0130742 | A1 | 5/2019 | Tokunaga | |
| 2019/0213873 | A1 | 7/2019 | Adireddy et al. | |
| 2019/0250626 | A1 | 8/2019 | Ghafarianzadeh et al. | |
| 2019/0311614 | A1 | 10/2019 | Yang et al. | |
| 2019/0347821 | A1 | 11/2019 | Stein | |
| 2019/0371180 | A1* | 12/2019 | Hara | G08G 1/164 |
| 2020/0064139 | A1* | 2/2020 | Mieth | G01C 21/32 |
| 2020/0090504 | A1 | 3/2020 | Kadar et al. | |
| 2020/0111349 | A1 | 4/2020 | Mubarek | |
| 2020/0135022 | A1 | 4/2020 | Xu et al. | |
| 2020/0166897 | A1 | 5/2020 | Campos et al. | |
| 2020/0238999 | A1 | 7/2020 | Batts et al. | |
| 2020/0242922 | A1 | 7/2020 | Dulberg et al. | |
| 2020/0272832 | A1 | 8/2020 | Urano et al. | |
| 2020/0324761 | A1 | 10/2020 | Magzimof et al. | |
| 2020/0327804 | A1 | 10/2020 | Xu et al. | |
| 2020/0365014 | A1 | 11/2020 | Ray et al. | |
| 2021/0004615 | A1 | 1/2021 | Yashiro et al. | |

FOREIGN PATENT DOCUMENTS

| | | | |
|---|---|---|---|
| WO | WO2017187883 | A1 | 11/2017 |
| WO | 2019195415 | A1 | 10/2019 |

OTHER PUBLICATIONS

Des Moines Register "Officials release video of deadly 50-car pileup on 1-35 near Ames" Source: https://www.desmoinesregister.com/story/news/2018/02/06/officials-release-video-deadly-50-car-pileup-35-near-ames/312908002/ Published: Feb. 6, 2018. (pp. 1).
Wikipedia. "Self-driving car" obtained from https://web.archive.org/web/20181021033945/https://en.wikipedia.org/wiki/Self-driving_car on Oct. 21, 2018. (pp. 1-39).
European Office Action for European Patent Application No. 19 205 956.6-1203 dated Sep. 28, 2021.

* cited by examiner

SLOWDOWN EVENTS

CROSS REFERENCE TO PRIOR APPLICATION

This application claims priority benefit of Provisional Application No. 62/751,747 filed Oct. 29, 2018, which is hereby incorporated by reference in its entirety.

FIELD

The following disclosure relates to the detection of slowdown events on a roadway and messages generated in response to the slowdown events.

BACKGROUND

There are various technologies currently available to provide traffic information. For example, the Traffic Message Channel (TMC) is a technology for broadcasting traffic and travel information to motor vehicle drivers. It is digitally coded, using the Radio Data System (RDS) on conventional FM radio broadcasts. It can also be transmitted on Digital Audio Broadcasting (DAB) or satellite radio. It should be noted that the broadcast RDS-TMC code is not globally unique and that broadcast uniqueness is only required regionally. The combination of Country Code, Table Number, and TMC Location Code is unique globally. An example of another technology is one known as the Transport Protocol Experts Group (TPEG) that was designed for the transmission of language independent multi-modal traffic and travel information.

While existing traffic information systems provide broad indicates of traffic levels along roadways over time, challenges remain in developing an efficient and immediate technique for detecting dangerous slowdown events at specific locations on roadways.

SUMMARY

In one embodiment, a method for providing alerts for a traffic slowdown includes receiving location data for at least a first vehicle of a plurality of vehicles, map matching the location data for at least the first vehicle to a road network, calculating an approaching speed for at least the first vehicle at a first time, calculating a final speed for at least the first vehicle at a second time, and generating a traffic slowdown message in response to the approaching speed and the final speed, wherein the traffic slowdown message includes at least one characteristic of the traffic slowdown.

In another embodiment, an apparatus for providing traffic alerts includes at least a location module, a speed module and a timing module. The location module is configured to identify a path for an initial vehicle. The speed module is configured to calculate an approaching speed for the initial vehicle and a final speed for the initial vehicle, and the speed module is further configured to compare the initial speed to a free flow threshold and compare the final speed to a final speed threshold. The timing module is configured to calculate a difference between a first time for the initial speed and a second time for the final speed and compare the difference between the first time and the second time to a time interval threshold. A slowdown message is generated in response to the initial speed exceeding the free flow threshold, the final speed being less than the final speed threshold, and the difference between first time and the second time being greater than the time interval threshold.

In another embodiment a non-transitory computer readable medium including instructions, that when executed by a processor, are configured to perform receiving location data for at least a first vehicle of a plurality of vehicles, map matching the location data for at least the first vehicle to a road segment of a road network, calculating an approaching speed for at least the first vehicle at a first time, calculating a final speed for at least the first vehicle at a second time, generating a traffic slowdown message in response to the approaching speed and the final speed, wherein the traffic slowdown message includes at least one characteristic of the traffic slowdown, and sending the traffic slowdown message to one or more subsequent vehicles of the plurality of vehicles having a horizon including the road segment for the first vehicle.

BRIEF DESCRIPTION OF THE DRAWINGS

Exemplary embodiments of the present invention are described herein with reference to the following drawings.

DETAILED DESCRIPTION

Figure 1A:
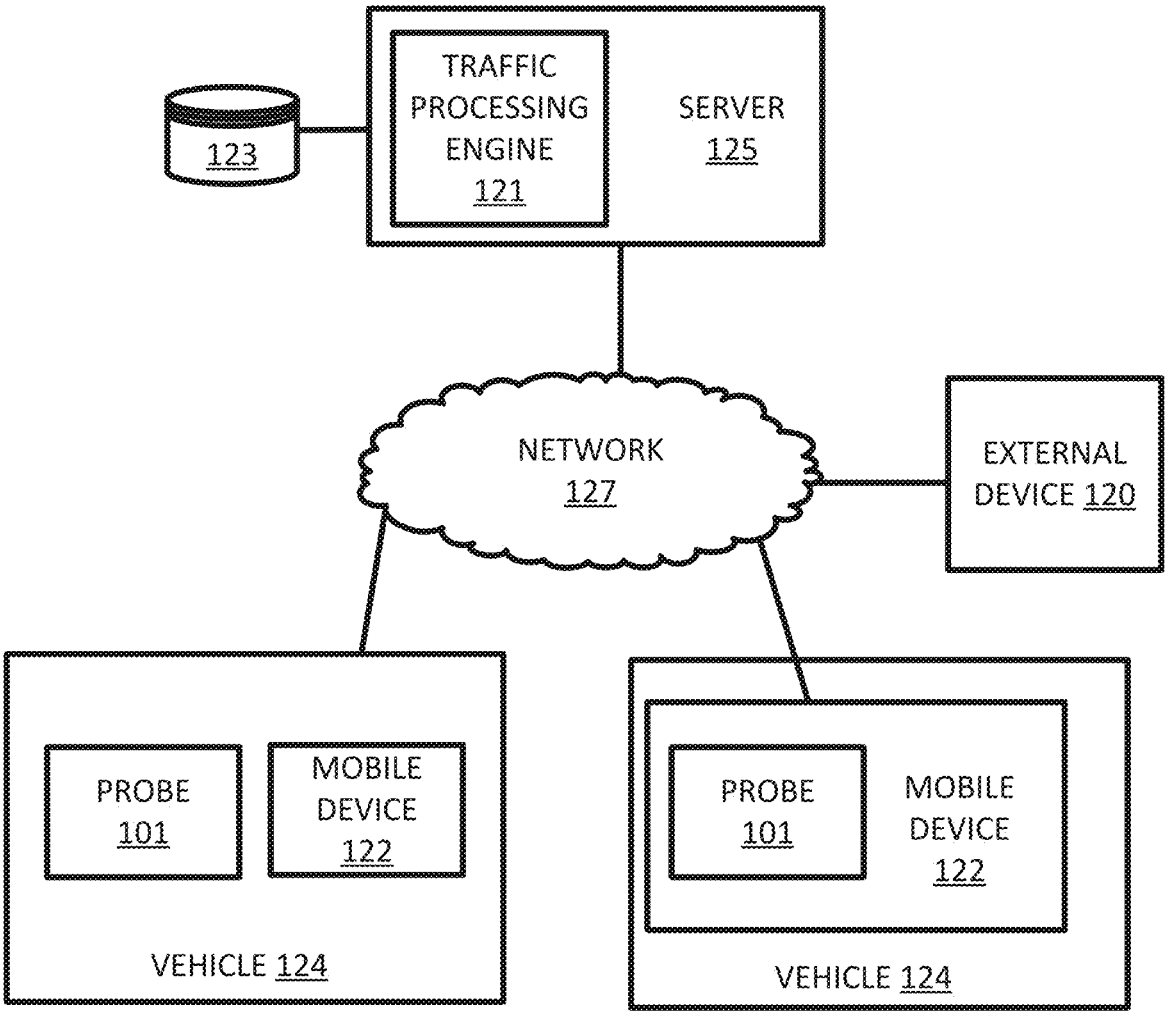
FIG. 1A illustrates an example system for detection of slowdown events.

This following embodiments include slowdown event detection methods and processing systems. Depending on one or more factors, a slowdown event may be determined to be a dangerous slowdown (DSD) event. The slowdown event may be an occurrence of abrupt slowdown of vehicles along a roadway. The slowdown event may occur when traffic slows or stops in response to a traffic incident. The traffic incident may be a collision, an accident, or a traffic jam. The slowdown event may be in response to a weather condition (e.g., white out, snow, ice, rain). The slowdown event may be a dangerous slowdown event as determined by the rate of decrease in speed of one or more vehicle on the roadway. The following embodiments collect data from probes from multiple resources as input and deliver flow or incident messages as output through a traffic processing engine. In one example, the messages are delivered to a traffic management system. The traffic management system may take one or more measures in response to at least one message. Example measures may include an instruction displayed on a roadway (e.g., speed limit or warning message), an emergency vehicle that is dispatched, a moving road block, or other type of road closure. In another example, the messages are delivered to end customers (e.g., client devices) in various ways including by over the air radio interfaces or by connected internet.

The slowdown event may be a result of traffic congestion queue/jam that may occur and start accumulating as a result of traffic volume exceeding the available road capacity. This may be caused by multiple reasons: weather such as heavy snow or fog, sport events, or other temporal events. Dangerous queuing situations may result in significant crashes or bottlenecks. These bottlenecks sometimes lead to secondary crashes, and on occasion lead to catastrophic events such as multiple vehicle pile-ups.

The following embodiments provide a single data source to address this need in a confident and low latency way. For example, these slowdown events may be reported in less than a predetermined delay (e.g., 10 minutes, 5 minutes, 1 minute, or 10 seconds) measured from the occurrent of the slowdown. In other example, these slowdown events may be reported in real time. The following embodiments address this critical safety issue and to be able to alert drivers to these dangerous driving conditions in a timely and targeted way.

The system for detection of slowdown events is in the technological field of automotive safety. Safety is improved when alerts sent to drivers prevent accidents for vehicles approaching the slowdown events. This can also support a governmental agency to identify these problem locations more quickly to help in better positioning service patrol resources (i.e., highway helper trucks). With such services, for example, the agency has the ability to alert all mobile phone users in a targeted area (through geofencing) using the state's emergency messaging system.

The system for detection of slowdown events is in the technological field of assisted or autonomous driving. Driving commands provided to the assisted or autonomous driving improve the driving experience because abrupt stops are prevented. Similarly, in assisted or autonomous driving systems, the driving commands in response to the slowdown prevents accidents. In addition, the system for detection of slowdown events may bring other benefits like a decrease in fuel consumption and an improvement in traffic flow. The system for detection of slowdown events is in the technological field of navigation. Improvements to navigation include more efficient routes that avoid slowdown events.

FIG. 1A illustrates an example system for detection of slowdown events. In FIG. 1A, one or more vehicles 124 are connected to the server 125 though the network 127. The vehicles 124 may be directly connected to the server 125 or through an associated mobile device 122. A traffic processing engine 121, including the server 125 and a geographic database 123, exchanges (e.g., receives and sends) data from the vehicles 124. The server 125 may process information data from the vehicles 124 and send instructions or messages to the vehicles 124, mobile devices 122, or an external device 120. The mobile devices 122 may include local databases corresponding to a local map, which may be modified according to the server 125. The local map may include a subset of the geographic database 123 and are updated or changed as the vehicles 124 travel. The mobile devices 124 may be standalone devices such as smartphones or devices integrated with vehicles. Additional, different, or fewer components may be included.

Each vehicle 124 and/or mobile device 122 may include position circuitry such as one or more processors or circuits for receiving GNSS signals and comparing the GNSS signals to a clock to determine the absolute or relative position of the vehicle 124 and/or mobile device 122. The mobile device 122 may act as probe 101 for determining the position or the mobile device 122 and the probe 101 may be separate devices. The absolute or relative position may be stored as location data. The location data may include geographic coordinates (e.g., longitude and latitude). The location data may include a heading and/or a speed. Alternatively, heading and/or speed may be calculated from a series of points of location data.

The traffic processing engine 121 may receive one or more data inputs from a subset of the vehicles 124 and provide one or more message to other vehicles 124 or to an external device 120. The inputs to the traffic processing engine 121 may include location data such as real time probe data including sensor data received from mobile devices 122 or probe vehicles 124, and map artifact data which describes the road segment topology and geometry. Upon receiving real time probe data, a traffic system engine normally processes the probe data, performs one or more processing steps such as map matching or pathing. The traffic processing engine 121 is configured to output an estimate of the current travel speed for a given road segment (e.g. road link or TMC). Based on the output speed category, the road condition can be further described as free flow, queuing, or stationary. From a user perception perspective, driving speed equal to or lower than queuing speed would be considered as road congestion.

The traffic processing engine 121 is configured to analyze the location data to identify slowdown events. The traffic processing engine 121 may identify a series of location data (e.g., samples of location data taken at time intervals) for a particular probe 101, mobile device 122, or vehicle 124. The traffic processing engine 121 may determine points in the series of location data that correspond to a predetermined section of roadway. The section of roadway may be a road segment or a portion of the road associated with a traffic message code. Alternatively, the traffic processing engine 121 may analyze the entire series of location data.

The traffic processing engine 121 may determine a first speed from the series of location data. The first speed (or initial speed) may be calculated from the two or more points (e.g., the first two points) of the series of location data. The first speed may alternatively be extracted from the first point in the series of location data (e.g., when the location data includes a speed value).

The traffic processing engine 121 may determine a second speed from the series of location data. The second speed (or final speed) may be calculated from two or more points (e.g., the last two points or more recent two points) of the series of location data. The second speed may alternatively be extracted from the last point in the series of location data (e.g., when the location data includes a speed value).

The traffic processing engine 121 may compare the first speed and the second speed to determine how quickly the corresponding vehicle 124 has slowed down. The traffic processing engine 121 may compare a difference between the second speed and the first speed to a slowdown threshold. The slowdown threshold may depend on a time interval between the measurements of the first speed and the second speed. The time interval may be calculated from subtract a timestamp associated with the first speed from a timestamp associated with the second speed. Examples for the slowdown threshold may be 10 miles per hour per second, 20 miles per hour second, or another threshold.

When the slowdown threshold is exceeded, the vehicle 124 has slowed down at a rate that indicates a slowdown event or a dangerous slowdown event. In response to the slowdown event, the traffic processing engine 121 may generate a slowdown message. The slowdown message may be transmitted to the external device 120 through the network 127. When the external device 120 is a traffic message center, the slowdown message may instruct the external device 120 to broadcast a warning to one or more other mobile device 122 or vehicles 124. When the external device 120 is a traffic message center, the slowdown message may instruct a sign to display an alert to other vehicles. Example alerts may include dangerous slowdown ahead, caution, or other warnings. The slowdown message may include a geographic location, a segment identifier, or a link PVID (published version identifier).

When the external device 120 is a transportation administrator (e.g., department of transportation device), the message may instruct a traffic diversion device. The traffic diversion device may include a vehicle that is dispatched ahead (e.g., upstream) of the slowdown event. The vehicle may warn subsequent vehicles or divert subsequent vehicles. The traffic diversion device may include signage that diverts or detours subsequent traffic.

Figure 1B:
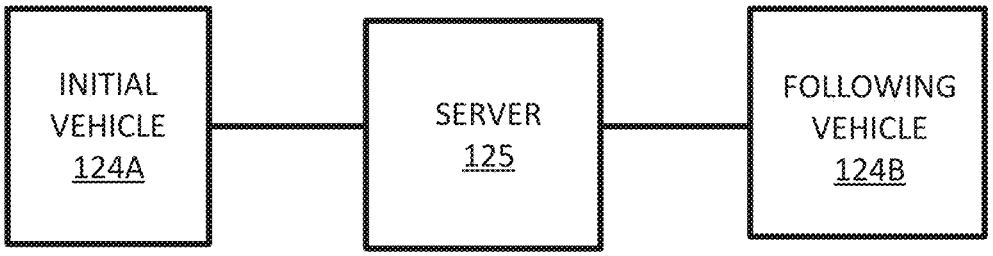
FIG. 1B illustrates a chain of communication for an example system for detection of slowdown events.

FIG. 1B illustrates a hierarchical chain of communication for reporting the slowdown event to another vehicle. The example of FIG. 1B includes the server 125, an initial vehicle 124A and a following vehicle 124B. There may be many following or subsequent vehicles. The term "following" refers to a vehicle that traverses the roadway later in time than the initial vehicle. The slowdown event message may be sent from the server 125 to the following vehicle 124B. The slowdown message may include an alert or instructions for the following vehicle 124B. The alert may indicate the location of the slowdown event and one or more messages warning the following vehicle 124B. The instructions may include navigational instruction or driving instructions, as discussed in more detail below.

Communication between the vehicles 124 and/or between the mobile device 122 and the server 125 through the network 127 may use a variety of types of wireless networks. Example wireless networks include cellular networks, the family of protocols known as WiFi or IEEE 802.11, the family of protocols known as Bluetooth, or another protocol. The cellular technologies may be analog advanced mobile phone system (AMPS), the global system for mobile communication (GSM), third generation partnership project (3GPP), code division multiple access (CDMA), personal handy-phone system (PHS), and 4G or long term evolution (LTE) standards, 5G, DSRC (dedicated short range communication), or another protocol. Communication between the vehicles 124 and/or between the mobile device 122 and the server 125 through the network 127 may use data messages over the air radio interface, TPEG service by connected HTTP or UDP protocol, and/or DSRC broadcasting data.

Figure 2:
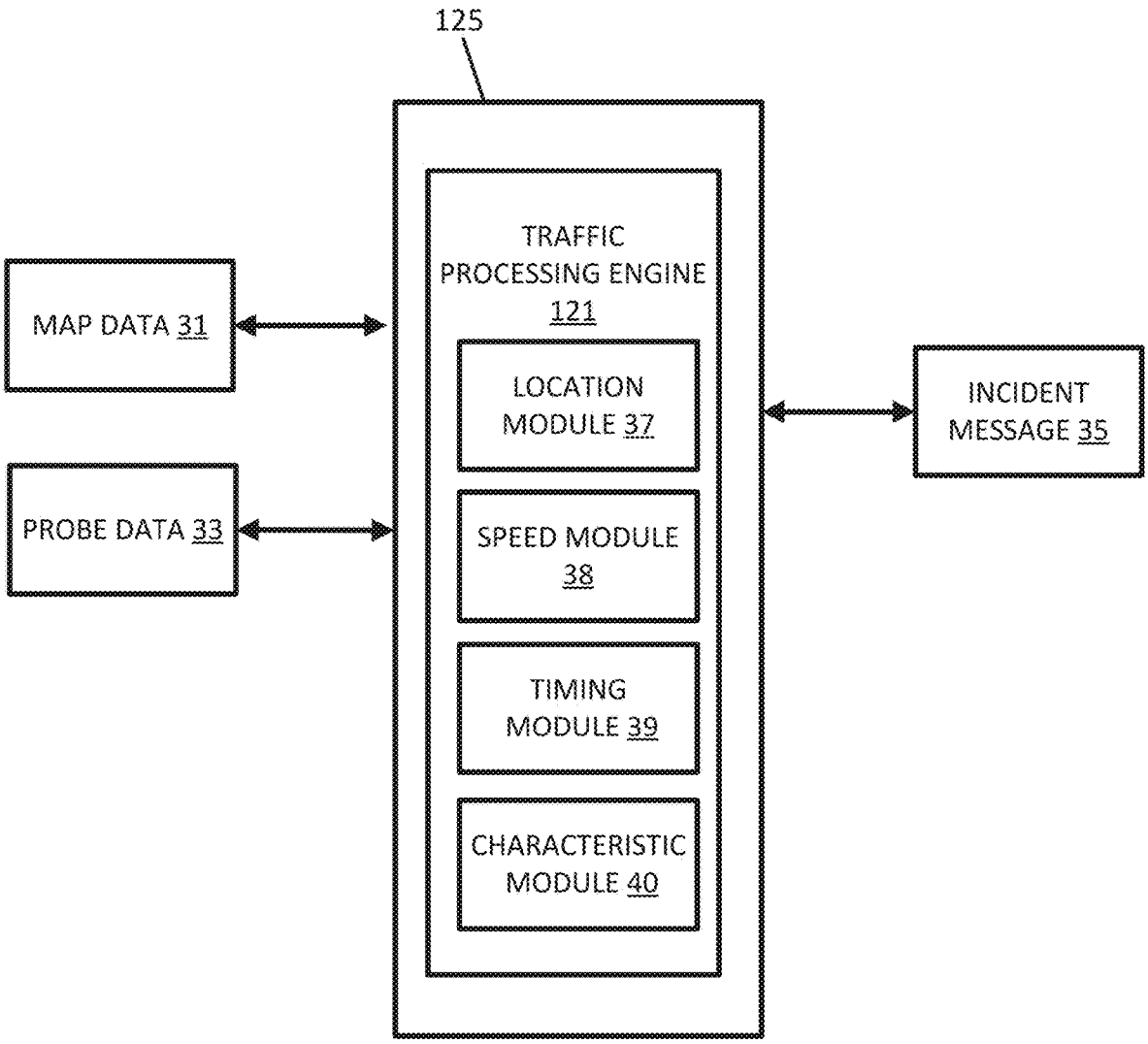
FIG. 2 illustrates an example traffic processing engine from the systems of FIGS. 1A and 1B.

FIG. 2 illustrates an example traffic processing engine 121 from the systems of FIGS. 1A and 1B. The traffic processing engine 121 may include a location module 37, a speed module 38, a timing module 39, and a characteristic module 40. The traffic processing engine 121 may include multiple inputs including map data 31 probe data 33. The traffic processing engine 121 generates the incident message 35. Additional, different, or fewer components may be included.

Figure 3:
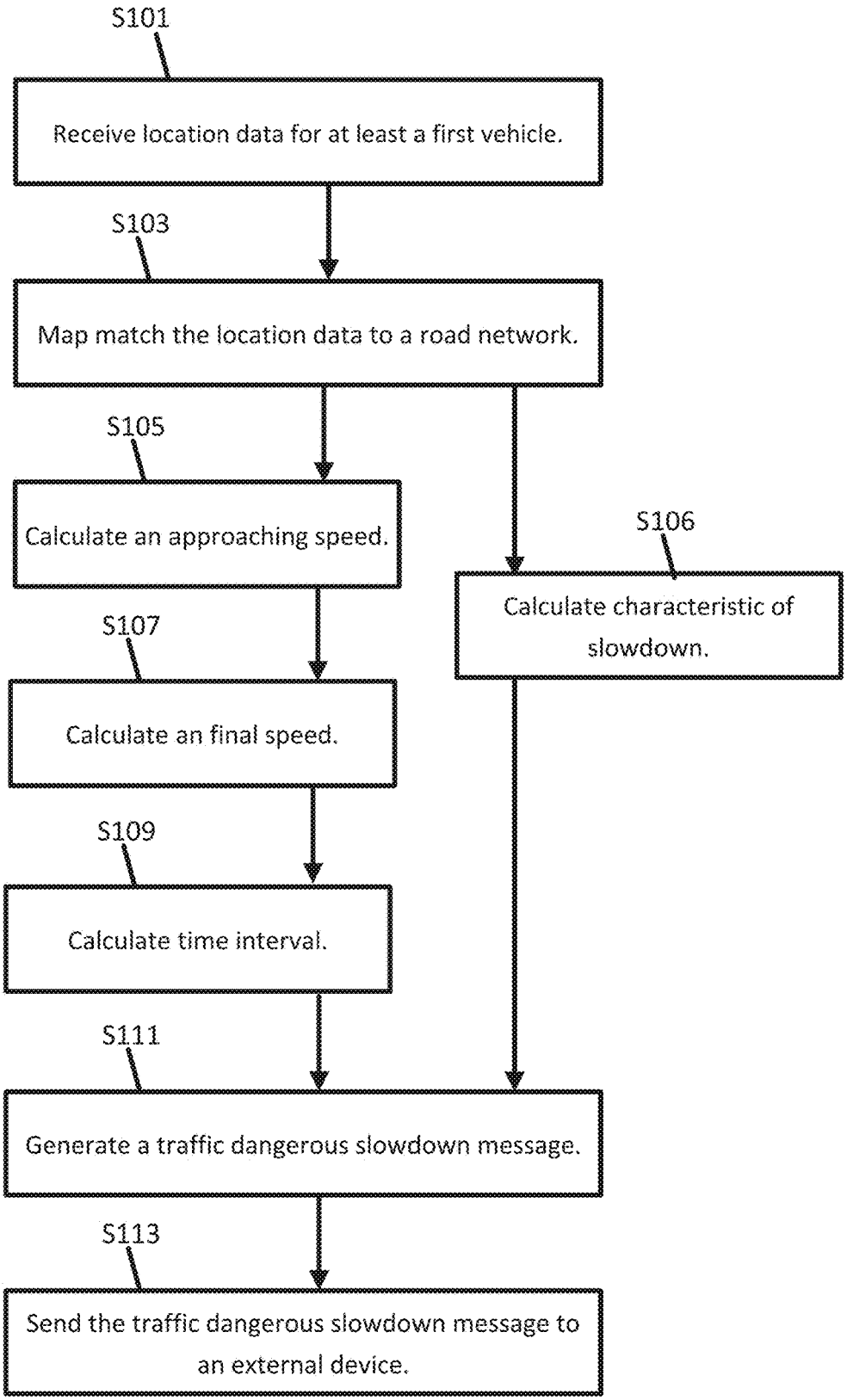
FIG. 3 illustrates an example flowchart for the traffic processing engine from the systems of FIGS. 1A and 1B.

FIG. 3 illustrates an example flowchart for the traffic processing engine from the systems of FIGS. 1A and 1B to provide alerts or commands in response to a traffic slowdown. The acts of the flowchart may be performed the traffic processing engine 121 or specific components illustrated in FIG. 2. Additional, different, or fewer acts may be included.

In act S101, the probe data 33 or location data is received at the traffic processing engine 121 for a vehicle or multiple vehicles. The probe data 33 may be received from one or more sources. In some examples, the probe data 33 is collected by a mobile device such as smartphone or portable computer running a mapping or navigation application that collects samples of locations data as latitude and longitude pairs over time. The probe data 33 may be collected by vehicles 124 by a similar navigation system. The probe data 33 may be received from a third party such as a service provider or government entity. The probe data 33 may be detected from sensors such as a camera (e.g., image processing on camera images to identify the locations of the vehicles) or a distance data detection system (e.g., light detection and ranging point cloud with the location of vehicles).

The traffic processing engine 121 analyzes the probe data at the location module 37 to determine paths for multiple vehicles. The location module 37 may identify a path for the leading vehicle 124*a*. In addition, the traffic processing engine 121 receives map data 31, for example, from the database 123. The map data 31 includes locations of road segments.

Figure 4:
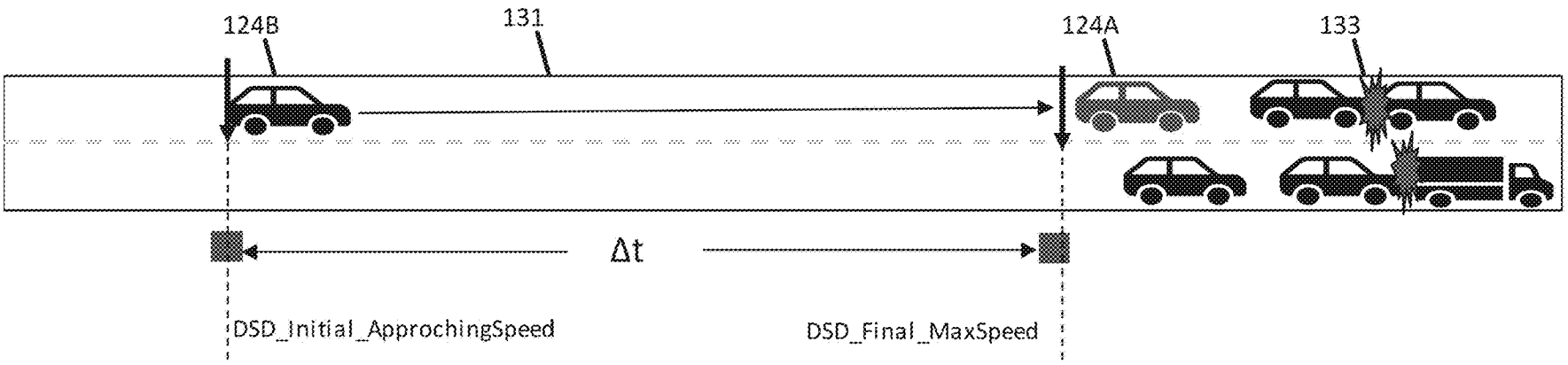
FIG. 4 illustrates an example slowdown event.

In act S103, the traffic processing engine 121 analyzes the probe data 33 based on the map data 31. The traffic processing engine 121 may map match the probe data 33 to the locations of the road segments in the map data 31. FIG. 4 illustrates a road segment 131 match with the location data for the initial vehicle 124A and the following vehicle 1248. Downstream of the initial vehicle 124A and the following vehicle 1248, an incident 133 has occurred.

In act S105, the traffic processing engine 121, through the speed module 38, calculates an approaching speed for at least the initial vehicle 124*a*. In some examples, the speed is extracted from the probe data 33 for the initial vehicle 124*a*. The approaching speed may be a free flow speed of the road segment. The traffic processing engine 121 is configured to compare the approaching speed to an initial speed threshold. Speeds over the initial speed threshold indicate that the vehicle is moving normally along the road segment. The initial speed threshold may be the free flow speed of the road segment or a predetermined percentage (e.g., 80% or 50%) of the free flow speed of the road segment.

In act S107, the traffic processing engine 121, through the speed module 38, calculates a final speed for at least the initial vehicle 124*a* at a second time. In some examples, the speed is extracted from the probe data 33 for the initial vehicle 124*a*. The final speed may be determined at any time that the initial vehicle 124*a* experiences a significant slowdown. For example, the speed module 38 may monitor that speed of the initial vehicle 124*a* and measure the final speed when a recent slowdown has occurred. The slowdown may be determined by an absolute or percentage drop in speed, which is a maximum speed threshold. The speed module 38 is configured to compare a difference in the final speed and the initial speed to maximum speed threshold. wherein the traffic slowdown message is generated in response to the difference exceeding the maximum speed threshold.

In one alternative, the speed module 38 may be configured to compare the final speed to a final speed threshold, and the traffic slowdown message is generated in response to the final speed being less than the final speed threshold.

Acts S105 and S107 for calculating the initial speed and the final speed may be performed in a variety of alternatives. The speeds may be calculated for a predetermined length of road such as a road segment, a portion of a road segment, or a geometry associated with a traffic message code. In other examples, the initial speed and the final speed are updated continuously by a configurable sliding window having a duration (less than a predefined time period for example 20 minutes). The sliding window may be defined and tracking by the timing module 39.

In act S109, the traffic processing engine 121, through the timing module 39 calculates a difference between a first time for the initial speed and a second time for the final speed. The timing module 39 is configured to compare the difference between the first time and the second time to a time interval threshold. The time interval threshold may be set according to a user input for the granularity of the slowdown detection. Larger duration for the time interval may improve detection quantity of slowdown events but may slow the response time in returning results from the detection.

The traffic processing engine 121 may determine that a slowdown event has occurred with a speed of a vehicle (e.g., initial vehicle 124A) has meet a minimum speed (e.g., initial speed threshold) and subsequently has been reduced by a certain percentage of speed (e.g., defined by the maximum speed threshold)/absolute difference with a predetermined time frame (e.g., the time interval threshold). The following pseudocode is an example for implementing the determination of a slowdown event. The pseudocode includes a double iterative loop that checks the point (P) of probe data (location, heading, and/or speed) such that a first loop determines if the initial speed threshold is met and a second loop determines if the slowdown is sever enough to be considered a slowdown event.

```
Algorithm DSD__Event__Detection
    Input: P, a sorted list of a vehicle's path probe points by GPS timestamp.
    Output: DSD event.
    if P.size = 0 return null
    for each probe point in P,
        do if
            i < j for all p[i], p[j] ∈ P,
     p[i].speed >= DSD__Initial__ApprochingSpeed,
     p[j].speed <= DSD__Final__MaxSpeed,
     delta time (p[j].time − p[i].time) < Δt
        return a DSD event composed of {p[i], p[j]} pair
 return null
```

In act S106, the traffic processing engine 121, through the characteristic module 40, calculates a characteristic of the slowdown. Examples characteristics of the slowdown may include a confidence factor and a severity factor. Act S106 may operate in parallel to acts S105-S109. Act S106 may operate in response to acts S105-S109.

The characteristic module 40 is configured to calculate the confidence value for the traffic slowdown message based on a first quantity associated with at least the first vehicle and a second quantity associated with an estimate of the total number of vehicles on the same slowdown road segment.

Table 1 illustrates an example where N represents the number (first quantity) of vehicles that are associated with the slowdown event. That is, the number of vehicles that through acts S105-S109 have experienced a threshold slowdown after attaining a threshold speed and in a threshold duration of times. The other vehicles on the same section of road, which may be defined according to a variety of techniques described herein have a quantity M. The confidence value is the ratio of N to M (N/M). Thus, the traffic processing engine 121 is configured to calculate a confidence number (CN): $\alpha$*N/M, where $\alpha$ is a standardized ratio $\in$[0,1] to represent data coverage level in a specific road segment in general.

TABLE 1

| Accident | N - number of DSD event | M - the number of probe paths | Ratio N/M |
|---|---|---|---|
| Accident_0 | 9 | 13 | 0.692 |

TABLE 1-continued

| Accident | N - number of DSD event | M - the number of probe paths | Ratio N/M |
|---|---|---|---|
| Accident_8 | 9 | 23 | 0.391 |
| Accident_3 | 13 | 18 | 0.722 |
| Accident_10 | 8 | 16 | 0.500 |
| Accident_14 | 7 | 11 | 0.636 |
| Accident_16 | 21 | 35 | 0.600 |

Figure 5:
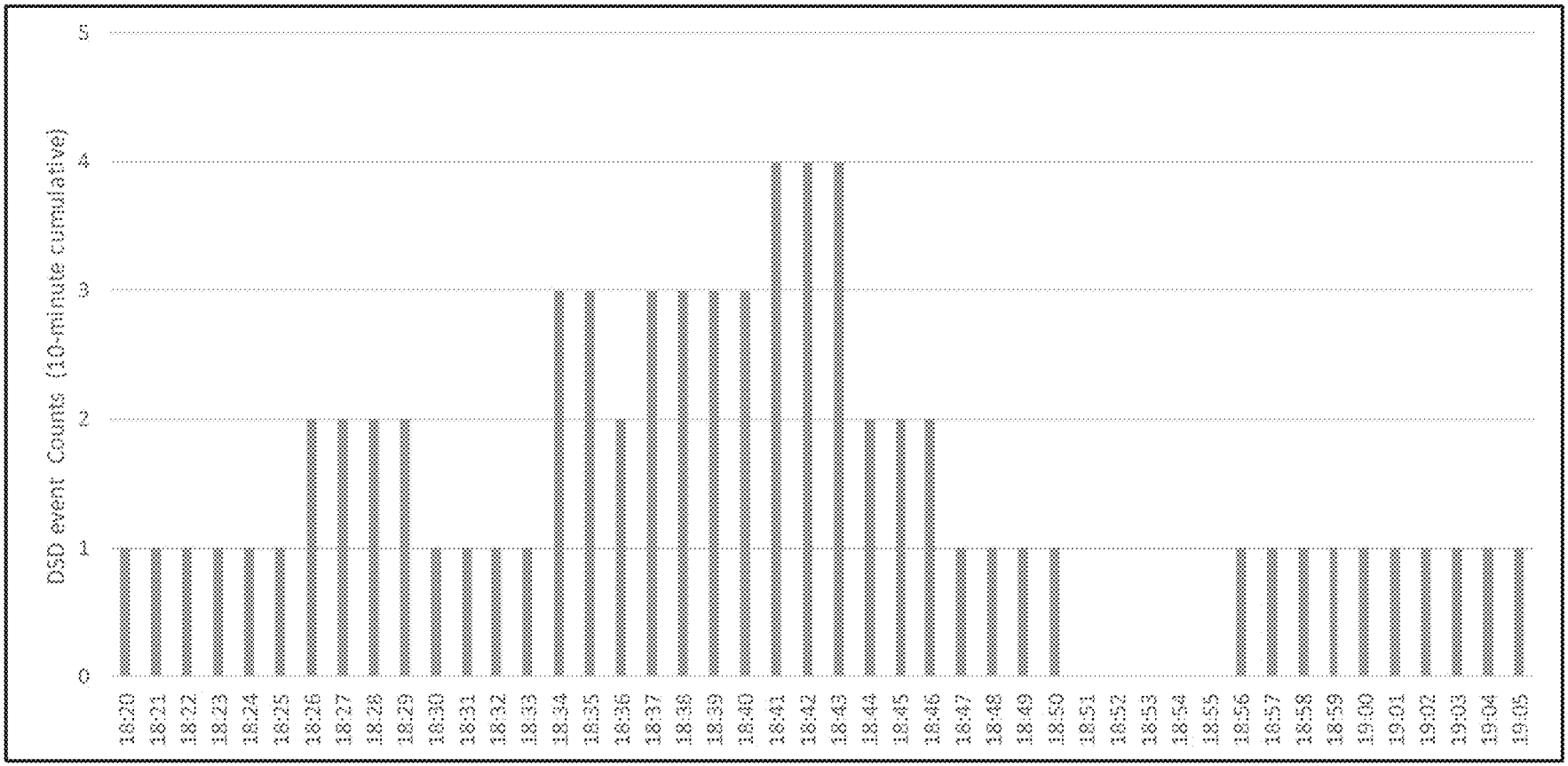
FIG. 5 illustrates a chart for slowdown event confidence value by time.

The likelihood that the slowdown has occurred, or is significant enough to warrant action, increases as the ratio is higher or approaches 1. FIG. 5 illustrates a chart that represents the calculation of the quantities M and N. FIG. 5 illustrates a time window with a count for the detection of the slowdown event during time intervals. The vertical axis indicates the count of slowdown events, which may be DSD events. The integral, or the sum over time, of the counts over the time window provides the quantity N of vehicles for the slowdown event. That is, the number of the counts of the slowdown events may be summed over a time window, as measured on the horizontal axis. The traffic processing engine 121 may sum the counts for a first time range and one or more second time ranges to calculate the quantity N of vehicles for the slowdown event for the time interval.

Figure 6:
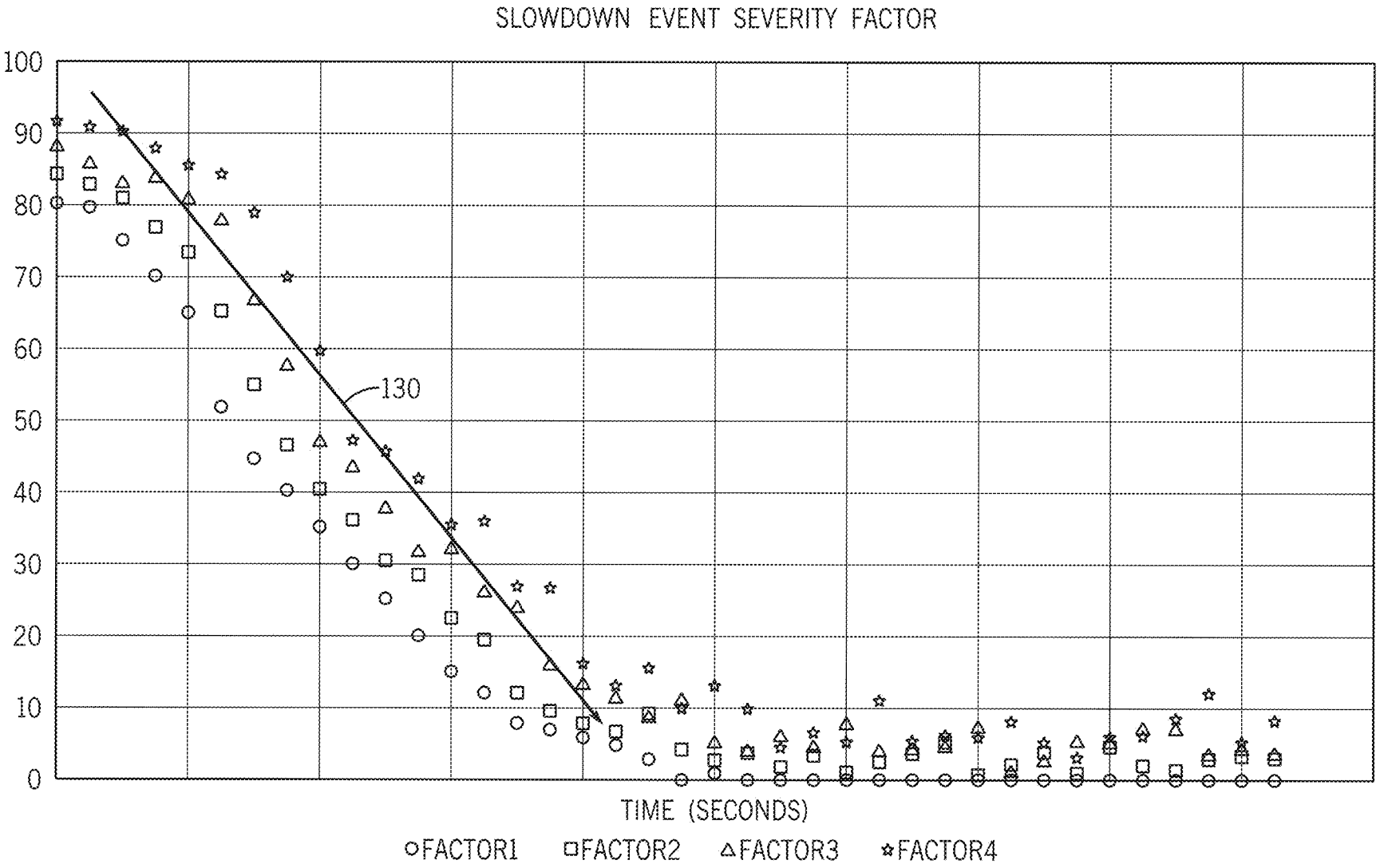
FIG. 6 illustrates a chart for severity factors for slowdown events.

The characteristic module 40 is also configured to calculate a severity value (or a deceleration value) based on a difference between the approaching speed and the final speed for at least the first vehicle. The severity value may be indicative of a slope of the change in speed for the vehicle. FIG. 6 illustrates an example set of time with four series that indicate the change in speed for four different vehicles. As illustrated in FIG. 6, vehicle 1 data points are illustrated as circles, vehicle 2 data points are illustrated as squares, vehicle 3 data points are illustrated as triangles, and vehicle 4 data points are illustrated as stars.

A line 130 that approximates or is fit to the data, or, in the illustrated example of FIG. 6, fit to the individual series for vehicle 3 in the data, and corresponds to a slope in the data. The traffic processing engine 121 may calculate the slope and assign a severity factor according to the slope.

In one example, the traffic processing engine 121 assigns four factors (e.g., factor 1, factor 2, factor 3, factor 4) to the data, for example, corresponding to the slopes of the data, to specify how much the speed drops in a certain time period.

Factor 1 may indicate that in delta t time period the speed drops over 20 kph but less than 40 kph. Factor 2 may indicate that in delta t time period, the speed drops over 40 kph but less than 60 kph. Factor 3 may indicate that in delta t time period, the speed drops over 60 kph but less than 80 kph. Factor 4 may indicate that in delta t time period, the speed drops over 80. The delta t may include various values such as 25, 50, 100, 105, or 240 seconds.

FIG. 6 illustrates how the calculation of the severity factor of a slowdown event categorized how much speed is dropped in certain period. The severity factor reflects the degree of dangerous event one vehicle behaves. Factor 4 (represents the most dangers slow down event, then Factors 3 and 2 are less dangerous comparing with 4, and Factor 1 may indicate normal slowdown.

The traffic processing engine 121 may aggregate slowdown events determined from multiple vehicles. For example, when a slowdown event is detected, the traffic processing engine 121 starts monitoring for additional slowdown events formed around the original slowdown event and aggregates all the events by their locations. In one example, a defined geographic distance is used or alternatively a break in the map data is used. Breaks in the map data may include political boundary, topographical boundaries, road segments boundaries, or TMC boundaries.

In act S111, the traffic processing engine 121 generates a traffic slowdown message in response to the approaching speed and the final speed. The traffic slowdown message includes at least one characteristic of the traffic slowdown. Multiple conditions are met before the slowdown message is generated. As described in act S105, the slow down message is generated in response to the approaching speed exceeding the initial speed threshold. As described in act S107, the slowdown message in generated in response to a reduction of speed of the vehicle exceeding the maximum speed threshold. As described in act S109, the traffic slowdown message is generated in response to the difference between the first time and the second time exceeding the time interval threshold.

The slowdown message may take several forms. The slowdown message may be sent from the traffic processing engine 121 to the external device 120. The external device 120 may be a department of transportation device or other type of traffic device or administrative device that monitors and controls the flow of traffic along the roadway. The external device 120 may receive the slowdown message and take action to mitigate the event causing the slowdown. In some examples, the external device 120 may warn other drivers by placing a customized message on a sign (e.g., accident ahead or caution) or illuminating a warning light (e.g. flashing yellow lights). Alternatively, the external device 120 may reroute traffic by illuminating a light (e.g., stop light) or a sign that instructs drivers to exit the road. The external device 120 may send warning to the individual vehicles. The external device 120 may dispatch a vehicle to location of the slowdown event including emergency vehicles or a moving roadblock that slows traffic that is approaching the event.

The slowdown message may be broadcast from the traffic processing engine 121 to mobile devices 122 or vehicles 124. The broadcast may be a radio broadcast. A radio transmission may be generated that includes the location of the slowdown event along with confidence value and/or severity factor through data messages over the air radio interface. Other examples for the communication include TPEG service by connected HTTP or UDP protocol, and/or DSRC broadcasting data.

Alternatively, the broadcast may be individual transmission sent to devices within a geofence or traveling along the same road segment or associated road segment. For example, the traffic processing engine 121 may identify other vehicles from the probe data 33 that are approaching the vent and send warning messages to the vehicles. The traffic processing engine 121 may also instruct vehicles to change their operation or reroute in response to the slowdown event, which is described in more detail below. For example, the traffic processing engine 121 may generate driving commands (e.g., included in the slowdown message), or the vehicle 124 may generate driving commands in response to the slowdown message and/or the traffic processing engine 121 may generate navigation commands (e.g., included in the slowdown message), or the vehicle 124 may generate navigation commands in response to the slowdown message.

The traffic processing engine 121 may send messages to different devices according to the at least one characteristic. For example, the slowdown message may be distributed to a first set of recipients when the confidence level is above a threshold and to a second set of recipients when the confidence level is below the threshold. Similarly, the slowdown message may be distributed to a first set of recipients when the severity level is above a threshold and to a second set of recipients with the severity level is below the threshold.

The traffic processing engine 121 may generate different types of messages according to the at least one characteristic. For example, the slowdown message may reroute traffic when the confidence level is above a threshold and simply warn drivers when the confidence level is below the threshold. Similarly, the slowdown message may be close the road when the severity level is above a threshold and illuminate a flashing light when the severity level is below the threshold.

The slowdown message may be distributed differently in different geographic regions. For example, in some areas such as Europe, slowdown events may be less dangerous because drivers tend to follow the "keep right except to pass" rule more diligently. Thus, in this geographic area, the slowdown messages may be sent out less liberally. Thus, the threshold for the at least one characteristic may be lower in Europe, than in North America, for example.

The traffic processing engine 121 may send the slowdown messages to different vehicles according to the characteristic. For example, the traffic processing engine 121 may distribute the slowdown messages to subsequent vehicles according to the horizon of the subsequent vehicles. A horizon may include one or more road segments that a vehicle is likely going to travel on according to a route or a current road segment. For example, if a vehicle is traveling on a road segment in a direction, the next road segment along the same road is part of the horizon of the vehicle. The horizon may be defined according to a predetermined distance or a predetermined number of road segments. The horizon may include multiple paths that diverge at an intersection. That is, the horizon may include alternate routes that a vehicle may travel (i.e., the horizon may include multiple paths leaving an intersection downstream of the current road segment). When the road segment where the slowdown event occurred (i.e., the road segment associated with the slowdown message), is part of the horizon for a subsequent vehicle, the traffic processing engine 121 sends the slowdown message to the subsequent vehicle.

The traffic processing engine 121 may dynamically adjust the horizon calculation for subsequent vehicles according to the characteristic. The horizon may be increased according to the characteristic. In response to slowdown events having a lower severity level, the traffic processing engine 121 may decrease the horizon or use a smaller bound for the horizon (e.g., low distance for the horizon, low number of road segments for the horizon). In response to slowdown events having a higher severity level, the traffic processing engine 121 may increase the horizon or use a larger bound for the horizon (e.g., large distance for the horizon, higher number of road segments for the horizon). In response to slowdown events having a low confidence level, the traffic processing engine 121 may decrease the horizon or use a smaller bound for the horizon (e.g., low distance for the horizon, low number of road segments for the horizon). In response to slowdown events having a high confidence level, the traffic processing engine 121 may increase the horizon or use a larger bound for the horizon (e.g., large distance for the horizon, higher number of road segments for the horizon). The traffic processing engine 121 may calculate the horizon for multiple vehicles. The traffic processing engine 121 may identify one or more road segments for the horizon based on the speed of the vehicle, a route calculated for the vehicle, statistical traffic patterns for likely paths taken according to one or more factors including time of day, day of week, or other person information for the driver of the vehicle. The traffic processing engine 121 may compare road segments in the horizon to the road segment where the slowdown event was detected, which may be the road segment identifier from the slowdown message.

Figure 7:
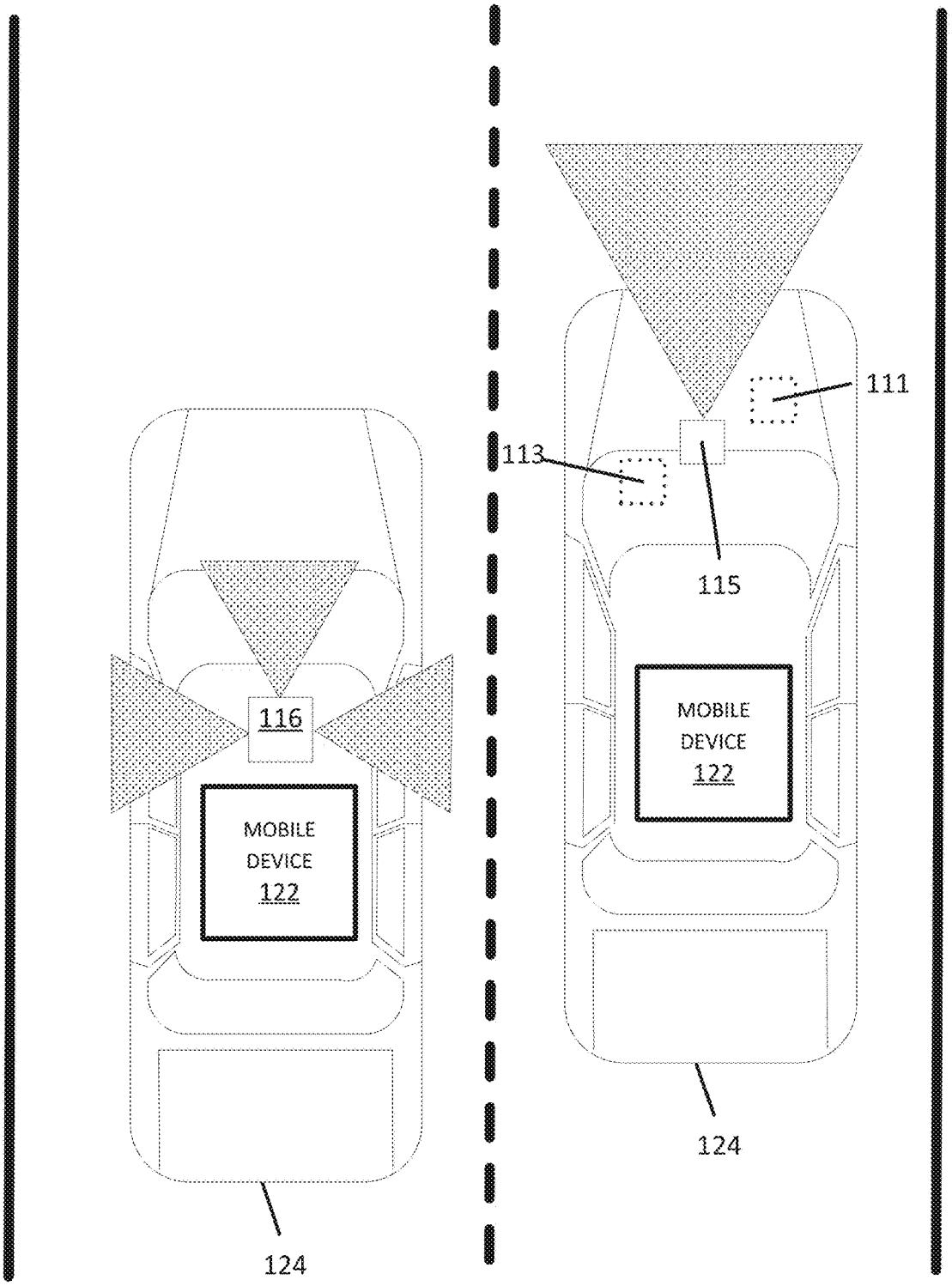
FIG. 7 illustrates an exemplary vehicle of the systems for detection of slowdown events.

FIG. 7 illustrates an exemplary vehicle 124. One of the vehicles 124 may be a collection vehicle configured to collect data in the area proximate to the vehicle 124. The collection vehicle may include one or more distance data collection device or sensor, such as a light detection and ranging (LiDAR) device. The distance data collection sensor may generate point cloud data. The distance data collection sensor may include a laser range finder that rotates a mirror directing a laser to the surroundings or vicinity of the collection vehicle on a roadway or another collection device on any type of pathway. Other types of pathways may be substituted for the roadway in any embodiment described herein.

A connected vehicle includes a communication device and an environment sensor array for reporting the surroundings of the vehicle 124 to the server 125. The connected vehicle may include an integrated communication device coupled with an in-dash navigation system. The connected vehicle may include an ad-hoc communication device such as a mobile device 122 or smartphone in communication with a vehicle system. The communication device connects the vehicle to a network including at least one other vehicle and at least one server. The network may be the Internet or connected to the internet.

The sensor array may include one or more sensors configured to detect surroundings of the vehicle 124. The sensor array may include multiple sensors. Example sensors include an optical distance system such as LiDAR 116, an image capture system 115 such as a camera, a sound distance system such as sound navigation and ranging (SONAR), a radio distancing system such as radio detection and ranging (RADAR) or another sensor. The camera may be a visible spectrum camera, an infrared camera, an ultraviolet camera or another camera.

The vehicles 124 may include a global positioning system, a dead reckoning-type system, cellular location system, or combinations of these or other systems, which may be referred to as position circuitry or a position detector. The positioning circuitry may include suitable sensing devices that measure the traveling distance, speed, direction, and so on, of the vehicle 124. The positioning system may also include a receiver and correlation chip to obtain a GPS signal. Alternatively or additionally, the one or more detectors or sensors may include an accelerometer built or embedded into or within the interior of the vehicle 124.

In some alternatives, additional sensors may be included in the vehicle 124. An engine sensor 111 may include a throttle sensor that measures a position of a throttle of the engine or a position of an accelerator pedal, a brake senor that measures a position of a braking mechanism or a brake pedal, or a speed sensor that measures a speed of the engine or a speed of the vehicle wheels. Another additional example, vehicle sensor 113, may include a steering wheel angle sensor, a speedometer sensor, or a tachometer sensor.

The slowdown event detection algorithm is not limited to mobile or vehicle probe data or sensor data, other kind of in vehicle data like engine speed, brake sensor event, acceleration or deacceleration sensor, camera sensor could also be used as the assistance for slowdown event detection and message reporting.

A mobile device 122 may be integrated in the vehicle 124, which may include assisted driving vehicles such as autonomous vehicles, highly assisted driving (HAD), and advanced driving assistance systems (ADAS). Any of these assisted driving systems may be incorporated into mobile device 122. Alternatively, an assisted driving device may be included in the vehicle 124. The assisted driving device may include memory, a processor, and systems to communicate with the mobile device 122. The assisted driving vehicles may respond to geographic data received from geographic database 123 and the server 125 and driving commands or navigation commands received from the traffic processing engine 121 or generated locally at the vehicle.

The term autonomous vehicle may refer to a self-driving or driverless mode in which no passengers are required to be on board to operate the vehicle. An autonomous vehicle may be referred to as a robot vehicle or an automated vehicle. The autonomous vehicle may include passengers, but no driver is necessary. These autonomous vehicles may park themselves or move cargo between locations without a human operator. Autonomous vehicles may include multiple modes and transition between the modes. The autonomous vehicle may steer, brake, or accelerate the vehicle based on the position of the vehicle in order, and may respond to geographic data received from geographic database 123 and the server 125 and driving commands or navigation commands received from the traffic processing engine 121 or generated locally at the vehicle.

A highly assisted driving (HAD) vehicle may refer to a vehicle that does not completely replace the human operator. Instead, in a highly assisted driving mode, the vehicle may perform some driving functions and the human operator may perform some driving functions. Vehicles may also be driven in a manual mode in which the human operator exercises a degree of control over the movement of the vehicle. The vehicles may also include a completely driverless mode. Other levels of automation are possible. The HAD vehicle may control the vehicle through steering or braking in response to the on the position of the vehicle, and may respond to geographic data received from geographic database 123 and the server 125 and driving commands or navigation commands received from the traffic processing engine 121 or generated locally at the vehicle.

Similarly, ADAS vehicles include one or more partially automated systems in which the vehicle alerts the driver. The features are designed to avoid collisions automatically. Features may include adaptive cruise control, automate braking, or steering adjustments to keep the driver in the correct lane. ADAS vehicles may issue warnings for the driver based on the position of the vehicle or based on to geographic data received from geographic database 123 and the server 125 and driving commands or navigation commands received from the traffic processing engine 121 or generated locally at the vehicle.

It is worth to note the disclosed embodiments may be applied to any of these HAD or autonomous driving as the safety assistance dynamic content with or without lane level knowledge acknowledged depending on what ADAS applications to be targeted. An autonomous vehicle uses different sensors technologies and HD MAP or dynamic backend content including traffic information services to aid the in vehicles ECM system for the right decision strategy as how to drive along the road network. The autonomy levels may be defined according to the following six levels.

Level 0: Automated system issues warnings and may momentarily intervene but has no sustained vehicle control. Level 1 ("hands on"): The driver and the automated system share control of the vehicle. Examples are Adaptive Cruise Control (ACC), where the driver controls steering and the automated system controls speed; and Parking Assistance, where steering is automated while speed is manual. The driver must be ready to retake full control at any time. Lane Keeping Assistance (LKA) Type II is a further example of level 1 self-driving. Level 2 ("hands off"): The automated system takes full control of the vehicle (accelerating, braking, and steering). The driver must monitor the driving and be prepared to intervene immediately at any time if the automated system fails to respond properly. The shorthand "hands off" is not meant to be taken literally. In fact, contact between hand and wheel is often mandatory during SAE 2 driving, to confirm that the driver is ready to intervene. Level 3 ("eyes off"): The driver can safely turn their attention away from the driving tasks, e.g. the driver can text or watch a movie. The vehicle will handle situations that call for an immediate response, like emergency braking. The driver must still be prepared to intervene within some limited time, specified by the manufacturer, when called upon by the vehicle to do so. The 2018 Audi A8 Luxury Sedan was the first commercial car to claim to be capable of level 3 self-driving. The car has a so-called Traffic Jam Pilot. When activated by the human driver, the car takes full control of all aspects of driving in slow-moving traffic at up to 60 kilometers per hour. The function works only on highways with a physical barrier separating one stream of traffic from oncoming traffic. Level 4 ("attention off"): As level 3, but no driver attention is ever required for safety, i.e. the driver may safely go to sleep or leave the driver's seat. Self-driving is supported only in limited spatial areas (geofenced) or under special circumstances, like traffic jams. Outside of these areas or circumstances, the vehicle must be able to safely abort the trip, i.e. park the car, if the driver does not retake control. Level 5 ("steering wheel optional"): No human intervention is required.

Figure 8:
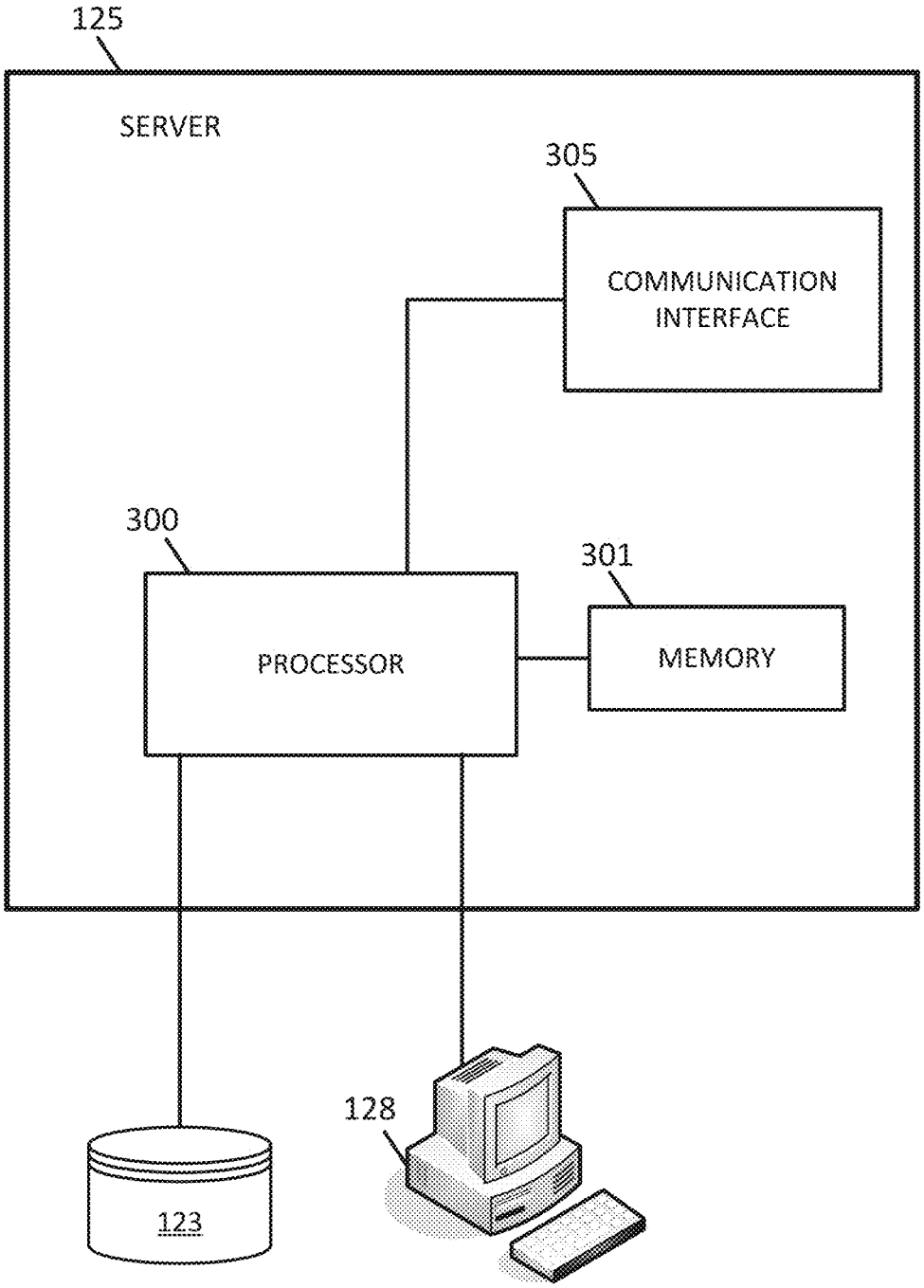
FIG. 8 illustrates an example server.

FIG. 8 illustrates an example server 125, which may apply to the system of FIG. 1. The server 125 includes a processor 300, a communication interface 305, a memory 301, and a database 123. An input device (e.g., keyboard or personal computer 128) may be used to enter settings to the server 125. Additional, different, or fewer components may be provided in the server 125.

Figure 9:
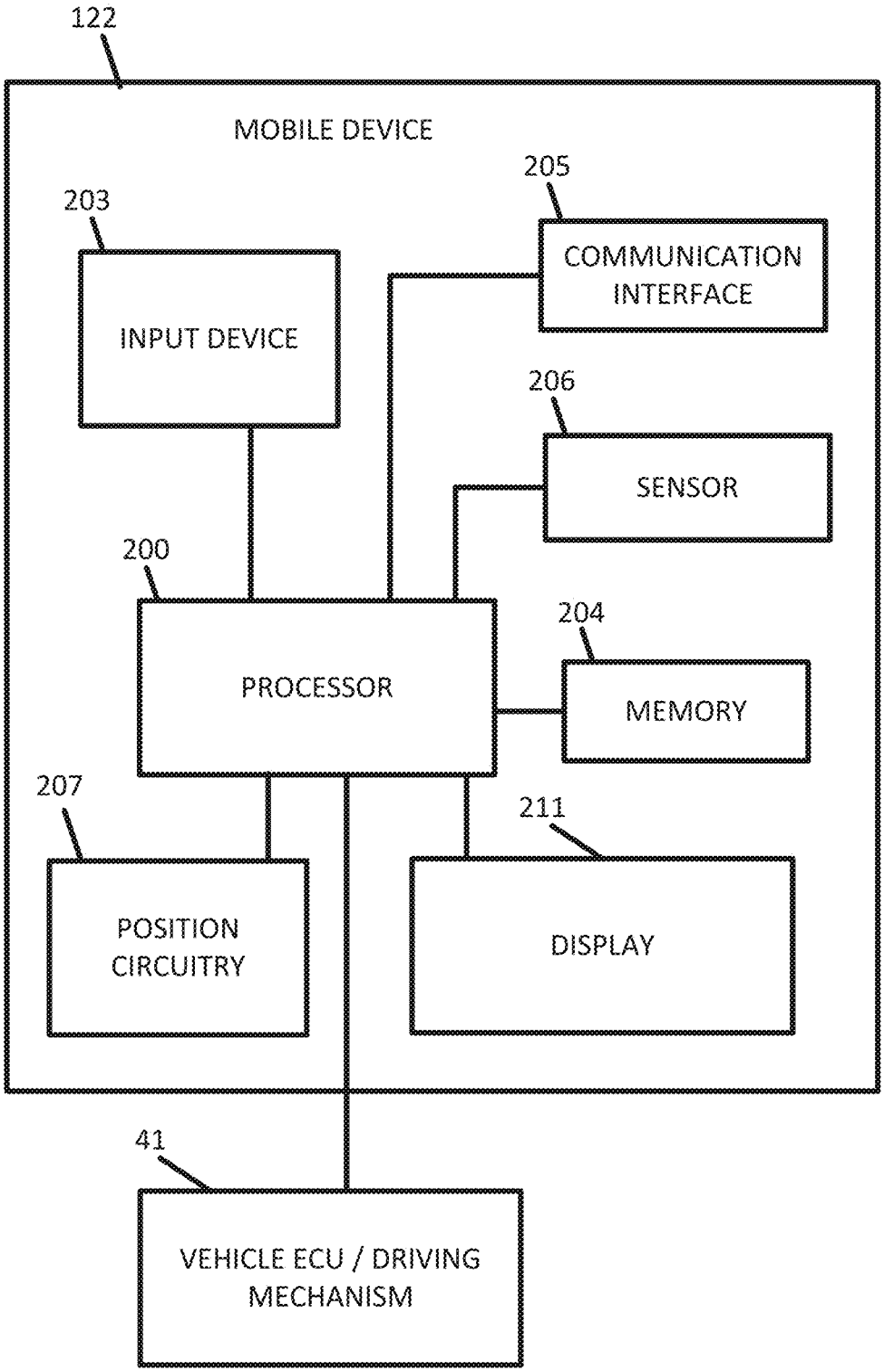
FIG. 9 illustrates an example mobile device.

FIG. 9 illustrates an exemplary mobile device 122 of the system of FIG. 1. The mobile device 122 includes a processor 200, a memory 204, an input device 203, a communication interface 205, position circuitry 207, a distance detector 209, a display 211, and a sensor 206. The input device 203 may receive commands from the user for default settings. The processor 200 may communicate with a vehicle ECU which operates one or more driving mechanisms 41 (e.g., accelerator, brakes, steering device). Alternatively, the mobile device 122 may be the vehicle ECU, which operates the one or more driving mechanisms directly. The sensor 206 may include a camera, a LiDAR device, or another sensor described herein. The sensor 206 may detect congestion local to the mobile device 122. The sensor 206 may detect when an intersection is approaching. Additional, different, or fewer components are possible for the mobile device 122.

The processor 200 may include a routing module including an application specific module or processor that calculates routing between an origin and destination. The routing module is an example means for generating a routing command based on the slowdown message. The routing command may be a route from the route to the destination. The routing command may be a driving instruction (e.g., turn left, go straight), which may be presented to a driver or passenger, or sent to an assisted driving system. The display 211 is an example means for displaying the routing command. The mobile device 122 may generate a routing instruction based on the slowdown message. The routing instructions may be provided by display 211. The mobile device 122 may be configured to execute routing algorithms to determine an optimum route to travel along a road network from an origin location to a destination location in a geographic region. Using input(s) including map matching values from the server 125, a mobile device 122 examines potential routes between the origin location and the destination location to determine the optimum route. The mobile device 122, which may be referred to as a navigation device, may then provide the end user with information about the optimum route in the form of guidance that identifies the maneuvers required to be taken by the end user to travel from the origin to the destination location. Some mobile devices 122 show detailed maps on displays outlining the route, the types of maneuvers to be taken at various locations along the route, locations of certain types of features, and so on. Possible routes may be calculated based on a Dijkstra method, an A-star algorithm or search, and/or other route exploration or calculation algorithms that may be modified to take into consideration assigned cost values of the underlying road segments.

The mobile device 122 may plan a route through a road system, or modify a current route through a road system in response to the request for additional observations of the road object. For example, when the mobile device 122 determines that there are two or more alternatives for the optimum route and one of the routes passes the initial observation point, the mobile device 122 selects the alternative that passes the initial observation point. The mobile devices 122 may compare the optimal route to the closest route that passes the initial observation point. In response, the mobile device 122 may modify the optimal route to pass the initial observation point.

The mobile device 122 may be a personal navigation device ("PND"), a portable navigation device, a mobile phone, a personal digital assistant ("PDA"), a watch, a tablet computer, a notebook computer, and/or any other known or later developed mobile device or personal computer. The mobile device 122 may also be an automobile head unit, infotainment system, and/or any other known or later developed automotive navigation system. Non-limiting embodiments of navigation devices may also include relational database service devices, mobile phone devices, car navigation devices, and navigation devices used for air or water travel.

The processor 200 and/or processor 300 may include a general processor, digital signal processor, an application specific integrated circuit (ASIC), field programmable gate array (FPGA), analog circuit, digital circuit, combinations thereof, or other now known or later developed processor. The processor 200 and/or processor 300 may be a single device or combinations of devices, such as associated with a network, distributed processing, or cloud computing.

The memory 204 and/or memory 301 may be a volatile memory or a non-volatile memory. The memory 204 and/or memory 301 may include one or more of a read only memory (ROM), random access memory (RAM), a flash memory, an electronic erasable program read only memory (EEPROM), or other type of memory. The memory 204 and/or memory 801 may be removable from the mobile device 122, such as a secure digital (SD) memory card.

The communication interface 205 and/or communication interface 305 may include any operable connection. An operable connection may be one in which signals, physical communications, and/or logical communications may be sent and/or received. An operable connection may include a physical interface, an electrical interface, and/or a data interface. The communication interface 205 and/or communication interface 305 provides for wireless and/or wired communications in any now known or later developed format.

The databases 123 may include geographic data used for traffic and/or navigation-related applications. The geographic data may include data representing a road network or system including road segment data and node data. The road segment data represent roads, and the node data represent the ends or intersections of the roads. The road segment data and the node data indicate the location of the roads and intersections as well as various attributes of the roads and intersections. Other formats than road segments and nodes may be used for the geographic data. The geographic data may include structured cartographic data or pedestrian routes.

The databases may also include other attributes of or about the roads such as, for example, geographic coordinates, street names, address ranges, speed limits, turn restrictions at intersections, and/or other navigation related attributes (e.g., one or more of the road segments is part of a highway or toll way, the location of stop signs and/or stoplights along the road segments), as well as points of interest (POIs), such as gasoline stations, hotels, restaurants, museums, stadiums, offices, automobile dealerships, auto repair shops, buildings, stores, parks, etc. The databases may also contain one or more node data record(s) which may be associated with attributes (e.g., about the intersections) such as, for example, geographic coordinates, street names, address ranges, speed limits, turn restrictions at intersections, and other navigation related attributes, as well as POIs such as, for example, gasoline stations, hotels, restaurants, museums, stadiums, offices, automobile dealerships, auto repair shops, buildings, stores, parks, etc. The geographic data may additionally or alternatively include other data records such as, for example, POI data records, topographical data records, cartographic data records, routing data, and maneuver data.

The databases may include historical traffic speed data for one or more road segments. The databases may also include traffic attributes for one or more road segments. A traffic attribute may indicate that a road segment has a high probability of traffic congestion.

The input device 203 may be one or more buttons, keypad, keyboard, mouse, stylus pen, trackball, rocker switch, touch pad, voice recognition circuit, or other device or component for inputting data to the mobile device 122. The input device 203 and display 211 may be combined as a touch screen, which may be capacitive or resistive. The display 211 may be a liquid crystal display (LCD) panel, light emitting diode (LED) screen, thin film transistor screen, or another type of display. The output interface of the display 211 may also include audio capabilities, or speakers. In an embodiment, the input device 203 may involve a device having velocity detecting abilities.

The positioning circuitry 207 may include suitable sensing devices that measure the traveling distance, speed, direction, and so on, of the mobile device 122. The positioning system may also include a receiver and correlation chip to obtain a GPS signal. Alternatively or additionally, the one or more detectors or sensors may include an accelerometer and/or a magnetic sensor built or embedded into or within the interior of the mobile device 122. The accelerometer is operable to detect, recognize, or measure the rate of change of translational and/or rotational movement of the mobile device 122. The magnetic sensor, or a compass, is configured to generate data indicative of a heading of the mobile device 122. Data from the accelerometer and the magnetic sensor may indicate orientation of the mobile device 122. The mobile device 122 receives location data from the positioning system. The location data indicates the location of the mobile device 122.

The positioning circuitry 207 may include a Global Positioning System (GPS), Global Navigation Satellite System (GLONASS), or a cellular or similar position sensor for providing location data. The positioning system may utilize GPS-type technology, a dead reckoning-type system, cellular location, or combinations of these or other systems. The positioning circuitry 207 may include suitable sensing devices that measure the traveling distance, speed, direction, and so on, of the mobile device 122. The positioning system may also include a receiver and correlation chip to obtain a GPS signal. The mobile device 122 receives location data from the positioning system. The location data indicates the location of the mobile device 122.

The position circuitry 207 may also include gyroscopes, accelerometers, magnetometers, or any other device for tracking or determining movement of a mobile device. The gyroscope is operable to detect, recognize, or measure the current orientation, or changes in orientation, of a mobile device. Gyroscope orientation change detection may operate as a measure of yaw, pitch, or roll of the mobile device.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionality as described herein.

Although the present specification describes components and functions that may be implemented in particular embodiments with reference to particular standards and protocols, the invention is not limited to such standards and protocols. For example, standards for Internet and other packet switched network transmission (e.g., TCP/IP, UDP/IP, HTML, HTTP, HTTPS) represent examples of the state of the art. Such standards are periodically superseded by faster or more efficient equivalents having essentially the same functions. Accordingly, replacement standards and protocols having the same or similar functions as those disclosed herein are considered equivalents thereof.

A computer program (also known as a program, software, software application, script, or code) can be written in any form of programming language, including compiled or interpreted languages, and it can be deployed in any form, including as a standalone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

As used in this application, the term 'circuitry' or 'circuit' refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

Processors suitable for the execution of a computer program include, by way of example, both general and special purpose microprocessors, and anyone or more processors of any kind of digital computer. Generally, a processor receives instructions and data from a read only memory or a random access memory or both. The essential elements of a computer are a processor for performing instructions and one or more memory devices for storing instructions and data. Generally, a computer also includes, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Computer readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry. In an embodiment, a vehicle may be considered a mobile device, or the mobile device may be integrated into a vehicle.

To provide for interaction with a user, embodiments of the subject matter described in this specification can be implemented on a device having a display, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

The term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored. These examples may be collectively referred to as a non-transitory computer readable medium.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit.

Embodiments of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings and described herein in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, are apparent to those of skill in the art upon reviewing the description.

The Abstract of the Disclosure is provided to comply with 37 C.F.R. § 1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

We claim:

1. A method for providing alerts for a traffic slowdown, the method comprising:

receiving location data for a plurality of vehicles including a first vehicle;

map matching the location data for at least the first vehicle to a road network;

calculating an approaching speed for at least the first vehicle at a first time;

calculating a final speed for at least the first vehicle at a second time;

identifying an event in response to the approaching speed and final speed; and generating a traffic slowdown message in response to the approaching speed exceeding a free flow threshold, the final speed being less than a final speed threshold, and the difference between first time and the second time being greater than a time interval threshold.

2. The method of claim 1, wherein the location data is probe data from a plurality of sources.

3. The method of claim 1, further comprising:

broadcasting traffic slowdown message to vehicles according to location.

4. The method of claim 1, further comprising:

sending a driving command to a vehicle in response to the traffic slowdown message.

5. The method of claim 1, further comprising:

sending a navigation command to a vehicle in response to the traffic slowdown message.

6. The method of claim 1, further comprising:

sending a traffic diversion message to a traffic device in response to the traffic slowdown message.

7. An apparatus for providing traffic alerts, the apparatus comprising:

a location module configured to identify a path for an initial vehicle;

a speed module configured to calculate an approaching speed for the initial vehicle and a final speed for the initial vehicle, the speed module further configured to compare the approaching speed to a free flow threshold and compare the final speed to a final speed threshold;

a timing module configured to calculate a difference between a first time for the approaching speed and a second time for the final speed and compare the difference between the first time and the second time to a time interval threshold, wherein a slowdown message is generated in response to the approaching speed exceeding the free flow threshold, the final speed being less than the final speed threshold, and the difference between first time and the second time being greater than the time interval threshold; and a module configured to calculate a confidence value based on a first quantity associated with the initial vehicle and a second quantity associated with a plurality of vehicles traveling on the path for the initial vehicle and compare the confidence value to a threshold selected according to a geographic region.

8. The apparatus of claim 7, wherein the time module determines the time interval threshold according to a granularity for slowdown detection.

9. The apparatus of claim 7, wherein a second vehicle is determined from the path for the initial vehicle, and the slowdown message is sent to the second vehicle.

10. The apparatus of claim 7, wherein the final speed threshold is a percentage drop in speed.

11. A non-transitory computer readable medium including instructions, that when executed by a processor, are configured to perform:

receiving location data for at least a first vehicle of a plurality of vehicles;

map matching the location data for at least the first vehicle to a road segment of a road network;

calculating an approaching speed for at least the first vehicle at a first time;

calculating a final speed for at least the first vehicle at a second time;

identifying an event in response to the approaching speed and final speed;

generating a traffic slowdown message in response to the approaching speed exceeding a free flow threshold, the final speed being less than a final speed threshold, and the difference between first time and the second time being greater than a time interval threshold, wherein the traffic slowdown message includes a confidence value based on a quantity of the plurality off vehicles the traffic slowdown; and sending the traffic slowdown message to one or more subsequent vehicles of the plurality of vehicles having a horizon including the road segment for the first vehicle.

12. The non-transitory computer readable medium of claim 11, wherein the horizon for the one or more subsequent vehicles is selected according to the at least one characteristic of the traffic slowdown.

13. The method of claim 1, wherein a portion of the road network associated with the event is defined by a traffic message channel boundary.

14. The method of claim 1, wherein a portion of the road network associated with the event is defined by map data.

15. The non-transitory computer readable medium of claim 11, wherein a portion of the road network associated with the event is defined by a traffic message channel boundary.

* * * * *